US007280009B2

(12) United States Patent
Reynolds et al.

(10) Patent No.: US 7,280,009 B2
(45) Date of Patent: Oct. 9, 2007

(54) RADIO FREQUENCY FILTER SYSTEMS AND METHODS

(75) Inventors: Robert L. Reynolds, Newbury Park, CA (US); Christ P. Tzelepis, Redondo Beach, CA (US); Bryan A. Kubo, Torrance, CA (US)

(73) Assignee: The Boeing Company, Chicago, IL (US)

( * ) Notice: Subject to any disclaimer, the term of this patent is extended or adjusted under 35 U.S.C. 154(b) by 93 days.

(21) Appl. No.: 11/105,933

(22) Filed: Apr. 13, 2005

(65) Prior Publication Data

US 2006/0232363 A1 Oct. 19, 2006

(51) Int. Cl.
*H01P 1/20* (2006.01)

(52) U.S. Cl. ..... 333/202; 333/219; 333/219.1

(58) Field of Classification Search ..... 333/202, 333/219.1, 219

See application file for complete search history.

(56) References Cited

U.S. PATENT DOCUMENTS 3,345,535 A * 10/1967 Johnson et al. ..... 315/39
4,688,009 A * 8/1987 Ferguson et al. ..... 333/252
5,488,336 A * 1/1996 Rivera et al. ..... 333/252
7,057,479 B2 * 6/2006 Furuya et al. ..... 333/202

FOREIGN PATENT DOCUMENTS

WO WO2004059784 A1 * 7/2004

* cited by examiner

*Primary Examiner*—Robert Pascal
*Assistant Examiner*—Kimberly E Glenn
(74) *Attorney, Agent, or Firm*—MacPherson Kwok Chen & Heid LLP; Greg J. Michelson

(57) ABSTRACT

Systems and methods are disclosed herein to provide filters for radio frequency applications. For example, in accordance with an embodiment of the present invention, a radio frequency filter includes a first dielectric layer having a first dielectric constant and a second dielectric layer having a second dielectric constant and disposed between the first dielectric layers, wherein the first dielectric constant is greater than the second dielectric constant.

17 Claims, 2 Drawing Sheets

RADIO FREQUENCY FILTER SYSTEMS AND METHODS

TECHNICAL FIELD

The present invention relates generally to electromagnetic energy applications, and, more particularly, to radio frequency filters.

BACKGROUND

Communication systems and other applications utilizing electromagnetic energy often require some type of filtering to remove undesirable frequencies. However, conventional filter techniques may have certain drawbacks in terms of performance or costs associated with implementation or manufacturing.

For example, a conventional tuned element or cavity microwave filter may not adequately accommodate widely separated frequency bands, such as waveguide filters that are single mode for a lower frequency band but are overmoded at a higher frequency band. Although various techniques have been developed to increase the performance of this filter, these techniques may result, for example, in small gaps that may limit their application (e.g., in space based applications) due to potential multipactor action. This type of filter also may require complex construction, which may include machining, dip brazing, or electroforming, resulting in a time consuming and expensive process. As a result, there is a need for improved filter techniques.

SUMMARY

Systems and methods are disclosed herein to provide filters for radio frequency applications. For example, in accordance with an embodiment of the present invention, a filter is disclosed for radio frequency (e.g., microwave and millimeter wave) applications. The filter may include, for example, multiple layers of various dielectric material positioned within the radio frequency (RF) transmission path to function as an RF (e.g., interference) filter.

More specifically, in accordance with one embodiment of the present invention, a radio frequency filter includes a first dielectric layer having a first dielectric constant; a second dielectric layer having a second dielectric constant, wherein the first dielectric constant is greater than the second dielectric constant; and a third dielectric layer having a third dielectric constant, wherein the third dielectric constant is greater than the second dielectric constant, and the second dielectric layer is disposed between the first dielectric layer and the third dielectric layer.

In accordance with another embodiment of the present invention, a communication system includes a radio frequency transmission path adapted to provide radio frequency signals; and means for filtering the radio frequency signals, wherein the filtering means comprises at least a first dielectric layer having a first dielectric constant, a second dielectric layer having a second dielectric constant, and a third dielectric layer having a third dielectric constant, with the first and third dielectric constants each greater than the second dielectric constant.

In accordance with another embodiment of the present invention, a method of filtering radio frequency electromagnetic energy includes providing at least a first dielectric layer having a first dielectric constant; providing a second dielectric layer having a second dielectric constant and disposed adjacent to the first dielectric layer; and providing a third dielectric layer having a third dielectric constant and disposed adjacent to the second dielectric layer, wherein the first and third dielectric constants are greater than the second dielectric constant, with the first, second, and third dielectric layers filtering the radio frequency electromagnetic energy.

In accordance with another embodiment of the present invention, a method of designing a filter for radio frequency signals includes determining a thickness and a first dielectric constant of a first dielectric layer; and determining a second dielectric constant of a second dielectric layer disposed between two of the first dielectric layers, wherein the first dielectric layers and the second dielectric layer filters radio frequency signals.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
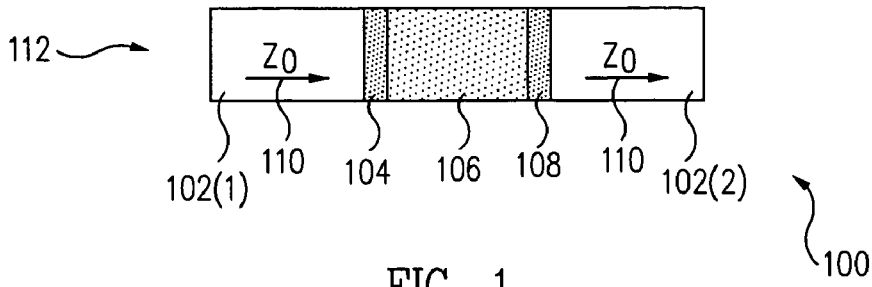
FIG. 1 shows a block diagram illustrating a filter in a transmission path in accordance with an embodiment of the present invention.

FIG. 1 shows a block diagram illustrating a filter 100 in a transmission path 112 in accordance with an embodiment of the present invention. Transmission path 112 may represent any type of transmission medium, channel, or structure that allows the electromagnetic energy to propagate or travel (e.g., on, in, or through by some means via the path). For example, transmission path 112 may represent a waveguide, a coaxial cable, a transmission line (e.g., a transverse electromagnetic (TEM) line), free space, or an antenna aperture cover. For this exemplary implementation, the direction of the electromagnetic energy (e.g., signal) is illustrated by arrows 110 within transmission path 112.

Filter 100 is located as part of (e.g., within) transmission path 112 to pass (i.e., allow) certain frequencies, while blocking (i.e., rejecting or reflecting) certain other frequencies attempting to travel down transmission path 112. For example, in accordance with an embodiment of the present invention, filter 100 includes one or more layers of alternating high dielectric constant material and low dielectric constant material, which are employed to pass or block selected frequencies or frequency bands traveling through transmission path 112.

As an example, the thickness of the high dielectric constant material may be implemented in one-half wavelength or multiples of a one-half wavelength to pass transmitted electromagnetic energy. Alternatively, the thickness of the high dielectric constant material may be implemented in one-quarter wavelength or odd multiples of a one-quarter wavelength to block (e.g., reject or reflect) the transmitted electromagnetic energy. The thickness of the high dielectric constant material, for example, may be specified as measured along the direction of travel of the electromagnetic energy or signal.

The low dielectric constant material may be implemented to space the high dielectric constant material at approximately one-half wavelength or multiples of a one-half wavelength to block the transmitted electromagnetic energy. Alternatively, the low dielectric constant material may be implemented to space the high dielectric constant material at approximately one-quarter wavelength or odd multiples of a one-quarter wavelength to pass the transmitted electromagnetic energy. The spacing of the high dielectric constant material, for example, may be specified as measured along the direction of travel of the electromagnetic energy or signal.

The high and low dielectric constant materials may be composed of organic or inorganic dielectric materials, while the low dielectric constant material may also in combination or solely be composed of free space. In general, in accordance with an embodiment of the present invention, filters having single or multiple layers of alternating high and low dielectric constant materials may be constructed by appropriate selection of dielectric constant values and dimensions (e.g., thickness and spacing of the layers) to form passing and blocking filter sections. These filters may be employed to provide, for example, various filter characteristics whose performance would be known or desired by one skilled in the art.

The appropriate selection of high and low dielectric constant values, materials, and dimensions may be determined, for example in accordance with an embodiment of the present invention, through modeling utilizing conventional simulation modeling techniques as would be understood by one skilled in the art. For example, by modeling the filter application through conventional RF modeling simulations, the number of dielectric layers, the dielectric constant values, and the various dimensions (e.g., thickness and spacing) may be determined and tuned to provide the desired filter characteristics and/or approximate filter performance for a given application. As an example, longer wavelengths may require the selection of materials having higher dielectric constants.

As a specific implementation example, as shown in FIG. 1, filter 100 includes free space regions 102(1) and 102(2) and dielectric layers 104, 106, and 108. Free space regions 102(1) and 102(2) have a dielectric constant of one and a loss tangent of zero.

Layers 104 and 108 may be made of a high dielectric constant material, such as for example a temperature stable microwave laminate, with layer 104 and layer 108 each having a thickness of 0.187 inches, a dielectric constant of 10, and a loss tangent of 0.01 (e.g., a TMM 10 material). As explained herein, for example, the thickness of layer 104 of 0.187 inches is measured from its boundary between layer 102(1) and layer 106 (e.g., a signal traveling in the direction of arrow 110 through transmission path 112 may pass through 0.187 inches of layer 104).

Layer 106 may be made of a low dielectric constant material, such as for example a Rohacell WF51 foam core having a thickness of 0.290 inches, a dielectric constant of 1.044, and a loss tangent of 0.002. As explained herein, for example, the thickness of layer 106 of 0.290 inches is measured from its boundary between layer 104 and layer 108 (e.g., a signal traveling in the direction of arrow 110 through transmission path 112 may pass through 0.290 inches of layer 106). As an example, FIGS. 2*a*-2*d* show exemplary performance plots of this specific exemplary implementation of filter 100 in accordance with an embodiment of the present invention.

Figure 2A:
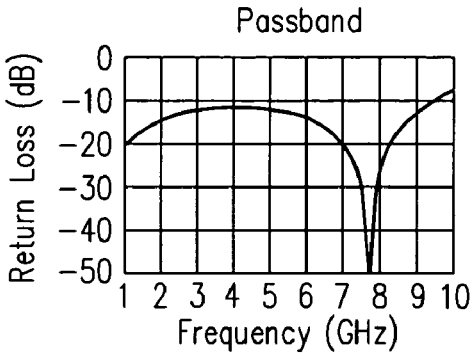
FIGS. 2*a*-2*d* show exemplary performance plots of a filter in accordance with an embodiment of the present invention.
Figure 2B:
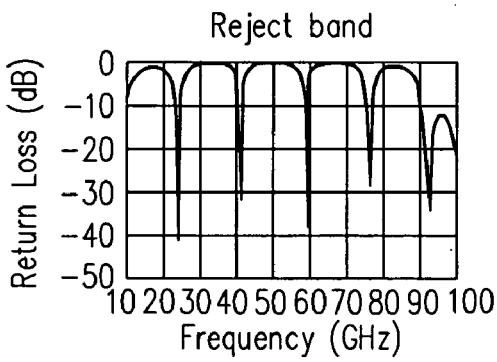
Figure 2C:
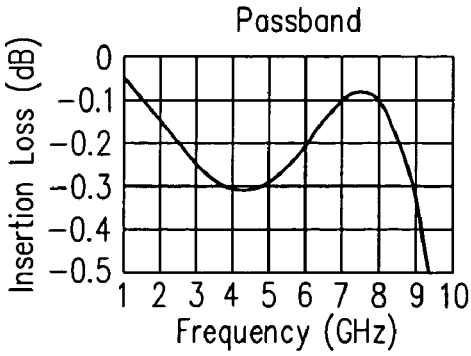
Figure 2D:
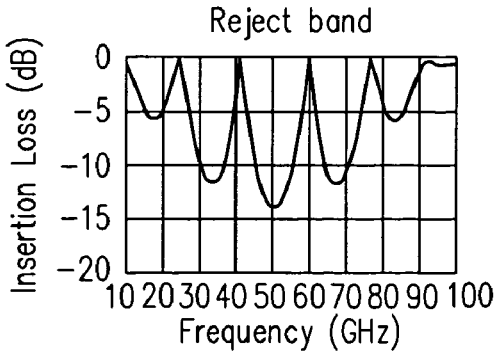

Specifically, FIGS. 2*a*-2*d* provide exemplary free space performance simulation results for filter 100, with layers 104 and 108 made of 0.0187 inches of TMM 10 material and layer 106 made of 0.29 inches of Rohacell WF51 foam core, as described above. FIGS. 2*a* and 2*b* plot the simulated RF return loss results as a function of frequency for the passband and reject bands, respectively. FIGS. 2*c* and 2*d* plot the simulated RF insertion loss results as a function of frequency for the passband and reject bands, respectively.

Layers 104 and 108 are tuned to provide destructive interference (e.g., reflection) for selected frequencies between 10 and 90 GHz. Layer 106 is tuned to provide constructive interference (e.g., pass) for a band of frequencies at approximately 7.6 GHz. The spacing provided by layer 106 also results in alternating constructive and destructive interference to occur, between layer 104 and layer 108, within the 10 to 90 GHz frequency bands. Thus, layers 104 and 108 and layer 106 may be adjusted to result in various pass bands and reject bands, as illustrated in FIGS. 2*a*-2*d*. Furthermore, additional layers or multiple sections of layers (e.g., filter 100 or variations of filter 100 repeated one or more times) may be included within transmission path 112 to provide further frequency rejection.

Figure 3:
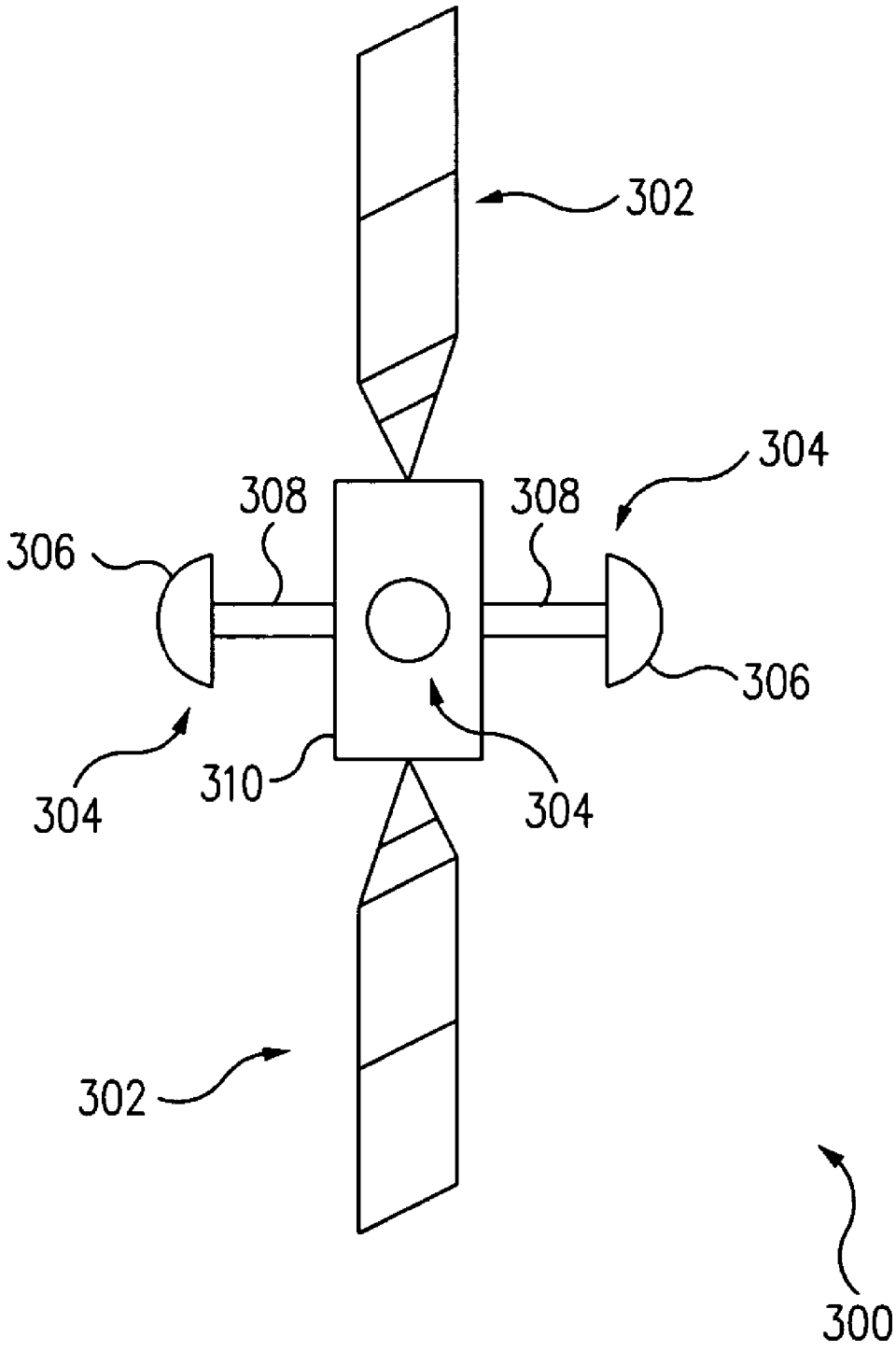
FIG. 3 shows a block diagram of a vehicle utilizing one or more filters in accordance with an embodiment of the present invention.

FIG. 3 shows a block diagram of a vehicle 300 utilizing one or more filters in accordance with an embodiment of the present invention. Vehicle 300 may represent a spacecraft or a satellite having solar panels 302 and antennas 304. However, it should be understood that the filter techniques disclosed may be incorporated into any type of vehicle, stationary structure, communication system (including a radar system), or any other application employing radio frequency electromagnetic energy (e.g., millimeter wave or microwave radio frequency energy).

For example, antennas 304 may have corresponding antenna covers 306 (e.g., antenna aperture covers or radomes) and also transmission paths 308 (e.g., transmit and/or receive paths) between corresponding antennas 304 and a main body 310 of vehicle 300. The filter techniques discussed herein (e.g., with respect to filter 100 (FIG. 1)), for example, may be applied to vehicle 300 for transmission paths 308 and/or antenna covers 306 in accordance with an embodiment of the present invention. Thus, transmission paths 308 and/or antenna covers 306 may include one or more layers of high and low dielectric constant material that are utilized to filter selected frequencies and provide certain filter characteristics.

In accordance with one or more embodiments of the present invention, the filter techniques discussed herein may be applicable for applications having filtering requirements covering a wide separation in frequencies or frequency bands. As an example, the filter, in accordance with an embodiment of the present invention, may be employed as a harmonic rejection filter, with the rejected frequency band being one or more multiples of the pass band frequency. As a specific example, a lower frequency transmitter (e.g., X-band transmitter) may potentially interfere with a number of higher frequency payloads (e.g., the fourth harmonic on the X-band transmitter may interfere with a Ka-band payload). By utilizing the filter techniques discussed herein, the fourth harmonic on the X-band transmitter may be filtered from the Ka-band transmission path (e.g., transmit and/or receive path).

Furthermore, the greater the frequency separation of pass to block frequency bands, the greater the filter efficiency may be that utilizes the techniques discussed herein. This relationship may be a distinct advantage as compared to some conventional filters, where the conventional filter design becomes more difficult and the conventional filter operates less efficiently as the frequency band separation increases.

As another example of a filter application, an ultra high frequency (UHF) satellite payload may produce harmonic and/or intermodulation products that are seven times the UHF frequency and fall within the bandwidth of an S-band omni receive channel (e.g., on vehicle 300). An economical seventh order reject filter, in accordance with an embodiment of the present invention, may be constructed by arranging the dielectric support spacers of the UHF TEM line at or near approximately UHF quarter wave increment "spacing" and by adjusting the "thickness" of the spacer at or near approximately the S-band quarter wave thickness. For a specific implementation example, this may provide a practical TEM line spacer arrangement of approximately 0.52 inch for alumina spacers, which have a dielectric constant of approximately 10 and are spaced approximately 11.5 inches apart. Because the TEM line may require mechanical support regardless, the addition of the filter elements (e.g., spacers) provides mechanical support and reduces RF interference and discrete filter requirements.

In general, as an implementation example, the dielectric layers of a filter, designed in accordance with one or more embodiments of the present invention, may be fabricated in a conventional transmission path (e.g., a conventional waveguide) by fitting several layers of precut dielectric within the conventional transmission path. Consequently, small gaps may be eliminated, which may reduce multipactor action concerns such as with space-based applications. Furthermore, the filter techniques disclosed herein may be implemented in combination with conventional filter techniques, with the dielectric layers of the filter used to enhance the performance of the conventional filter techniques.

As described herein, one or more dielectric layers may be "tuned" to improve the passage and/or filtering of RF signals in free space, transmission path, or antenna aperture cover applications. This type of filter design may be viewed as being based, at least partially, on constructive and destructive interference, which may be employed in a similar fashion in optical systems (e.g., optical filter technology). Furthermore, this type of filter design may be particularly useful in situations where a transmission path will propagate multiple modes, when there is a broad separation between frequency bands, or in millimeter wave or microwave antenna horn aperture covers (e.g., sunshields).

Systems and methods are disclosed herein to provide filters for electromagnetic energy applications. For example, in accordance with an embodiment of the present invention, filters are disclosed for radio frequency applications, such as for microwave and millimeter wave frequencies. One or more of the filters may be applicable for applications having filtering requirements covering a wide separation in frequencies or frequency bands.

For example, millimeter wave or microwave antenna aperture cover RF filters or free space filters currently exist in the form of conventional periodic element frequency selective surfaces (FSS). However, although the multilayer dielectric filter disclosed herein, in accordance with one or more embodiments of the present invention, may be physically larger, the multilayer dielectric filter may have greater range in terms of bandwidth, rejection, and other performance measurements. For example, the simulation plot results illustrated in FIG. 2 may be viewed as providing the response of a free space filter or antenna aperture cover filter that would be difficult to produce with conventional FSS technology.

The techniques disclosed herein could be applied to other types of known filters (e.g., in the microwave or millimeter wave frequency bands and alone or in combination with the filters disclosed herein) and could be constructed of single or multiple dielectric layers. Furthermore, using the techniques disclosed herein could reduce design, construction, and/or cost when applied to the known filters or filter applications. Alternatively, the filters disclosed herein in accordance with one or more embodiments of the present invention may provide certain advantages over conventional techniques and may offer greater flexibility in filter design and at a lower cost. For example, in accordance with an embodiment of the present invention, waveguide filters may be produced at a lower cost due to reduced processing and manufacturing costs relative to conventional technology.

Embodiments described above illustrate but do not limit the invention. It should also be understood that numerous modifications and variations are possible in accordance with the principles of the present invention. Accordingly, the scope of the invention is defined only by the following claims.

We claim:

1. A radio frequency filter comprising:

a first dielectric layer having a first dielectric constant;

a second dielectric layer having a second dielectric constant, wherein the first dielectric constant is greater than the second dielectric constant; and a third dielectric layer having a third dielectric constant, wherein the third dielectric constant is greater than the second dielectric constant, and the second dielectric layer is disposed between the first dielectric layer and the third dielectric layer;

wherein a thickness of the first dielectric layer is approximately a half wavelength or a multiple of a half wavelength of a frequency to pass, and wherein a spacing provided by the second dielectric layer between the first and third dielectric layers is approximately a half wavelength or a multiple of a half wavelength of a frequency to block.

2. The radio frequency filter of claim 1, wherein a thickness of the first and third dielectric layers and a spacing provided by the second dielectric layer between the first dielectric layer and the third dielectric layer determines frequencies that are passed and rejected by the radio frequency filter.

3. The radio frequency filter of claim 1, wherein the first and third dielectric layers comprise at least one of an organic dielectric material and an inorganic dielectric material, and the second dielectric layer comprises at least one of an organic dielectric material, an inorganic dielectric material, and a free space.

4. The radio frequency filter of claim 1, wherein the radio frequency filter is in a transmission path comprising a waveguide, a coaxial cable, a transverse electromagnetic line, a free space, an antenna cover, and an antenna aperture cover.

5. The radio frequency filter of claim 1, wherein the first dielectric layer and the third dielectric layer comprise a TMM 10 material and the second dielectric layer comprises a Rohacell WF51 material.

6. The radio frequency filter of claim 1, wherein the radio frequency filter is formed as part of a communication system.

7. A communication system comprising:

a radio frequency transmission path adapted to provide radio frequency signals; and means for filtering the radio frequency signals, wherein the filtering means comprises at least a first dielectric layer having a first dielectric constant, a second dielectric layer having a second dielectric constant, and a third dielectric layer having a third dielectric constant, with the first and third dielectric constants each greater than the second dielectric constant;

wherein the filtering means comprises a plurality of sections, with the second dielectric layer separating the first dielectric layer and the third dielectric layer and providing alternating constructive and destructive frequency interference between the first and third dielectric layers that provide constructive frequency interference.

8. The communication system of claim 7, wherein a thickness of the first dielectric layer and the third dielectric layer and a spacing between the first dielectric layer and the third dielectric layer, provided by the second dielectric layer, determines frequencies that are passed and rejected by the filtering means.

9. The communication system of claim 8, wherein the thickness of the first dielectric layer is at least one of approximately a half wavelength or a multiple of a half wavelength of a frequency to pass and approximately a quarter wavelength or an odd multiple of a quarter wavelength of a frequency to block, and wherein the spacing between the first dielectric layer and the third dielectric layer is at least one of approximately a quarter wavelength or an odd multiple of a quarter wavelength of a frequency to pass and approximately a half wavelength or a multiple of a half wavelength of a frequency to block.

10. The communication system of claim 7, wherein the communication system is formed as part of at least one of an aircraft, a spacecraft, and a satellite, with the radio frequency transmission path comprising at least one of a waveguide, a coaxial cable, a transverse electromagnetic line, an antenna cover, and an antenna aperture cover.

11. A method of filtering radio frequency electromagnetic energy, the method comprising:

providing at least a first dielectric layer having a first dielectric constant, wherein a thickness of the first dielectric layer is at least one of approximately a half wavelength or a multiple of a half wavelength of a frequency to pass and approximately a quarter wavelength or an odd multiple of a quarter wavelength of a frequency to block;

providing a second dielectric layer having a second dielectric constant and disposed adjacent to the first dielectric layer; and providing a third dielectric layer having a third dielectric constant and disposed adjacent to the second dielectric layer, wherein the first and third dielectric constants are greater than the second dielectric constant, with the first, second, and third dielectric layers filtering the radio frequency electromagnetic energy;

wherein the second dielectric layer is disposed between the first dielectric layer and the third dielectric layer to provide a spacing, and wherein the spacing is at least one of approximately a quarter wavelength or an odd multiple of a quarter wavelength of a frequency to pass and approximately a half wavelength or a multiple of a half wavelength of a frequency to block.

12. A method of designing a filter for radio frequency signals, the method comprising:

determining a thickness and a first dielectric constant of a first dielectric layer;

determining a second dielectric constant of a second dielectric layer disposed between two of the first dielectric layers, wherein the first dielectric layers and the second dielectric layer filters radio frequency signals; and determining a thickness of the second dielectric layer, which sets a spacing between the first dielectric layer and a subsequent one of the first dielectric layers, wherein a thickness of the first dielectric layer is at least one of approximately a half wavelength or a multiple of a half wavelength of a frequency to pass and approximately a quarter wavelength or an odd multiple of a quarter wavelength of a frequency to block, and wherein the spacing is at least one of approximately a quarter wavelength or an odd multiple of a quarter wavelength of a frequency to pass and approximately a half wavelength or a multiple of a half wavelength of a frequency to block;

wherein the second dielectric layer separating the first dielectric layers provides alternating constructive and destructive frequency interference between the first dielectric layers that provide constructive frequency interference.

13. The radio frequency filter of claim 1, wherein the second dielectric layer separates the first dielectric layer and the third dielectric layer and provides alternating constructive and destructive frequency interference between the first and third dielectric layers that provide constructive frequency interference.

14. The communication system of claim 7, wherein the first dielectric layer and the third dielectric layer comprise a TMM 10 material and the second dielectric layer comprises a Rohacell WF51 material.

15. The method of claim 11, wherein the second dielectric layer separates the first dielectric layer and the third dielectric layer and provides alternating constructive and destructive frequency interference between the first and third dielectric layers that provide constructive frequency interference.

16. The method of claim 11, wherein the first dielectric layer and the third dielectric layer comprise a TMM 10 material and the second dielectric layer comprises a Rohacell WF51 material.

17. The method of claim 12, wherein the first dielectric layers comprise a TMM 10 material and the second dielectric layer comprises a Rohacell WF51 material.

* * * * *